US009875693B2

(12) United States Patent
Kwon et al.

(10) Patent No.: US 9,875,693 B2
(45) Date of Patent: Jan. 23, 2018

(54) DATA DRIVER AND ORGANIC LIGHT EMITTING DISPLAY DEVICE HAVING THE SAME

(71) Applicants: Samsung Display Co., LTD., Yongin-si, Gyeonggi-do (KR); KOREA ADVANCED INSTITUTE OF SCIENCE AND TECHNOLOGY, Daejeon (KR)

(72) Inventors: Oh-Jo Kwon, Suwon-si (KR); Ji-Woong Kim, Suwon-si (KR); Choong-Sun Shin, Yongin-si (KR); Joo-Hyung Lee, Gwacheon-si (KR); Jun-Suk Bang, Seoul (KR); Gyu-Hyeong Cho, Daejeon (KR)

(73) Assignee: Samsung Display Co., Ltd., Yongin-si (KR)

( * ) Notice: Subject to any disclaimer, the term of this patent is extended or adjusted under 35 U.S.C. 154(b) by 169 days.

(21) Appl. No.: 14/983,512

(22) Filed: Dec. 29, 2015

(65) Prior Publication Data

US 2016/0372050 A1 Dec. 22, 2016

(30) Foreign Application Priority Data

Jun. 16, 2015 (KR) ..... 10-2015-0084742

(51) Int. Cl.
*G09G 5/00* (2006.01)
*G09G 3/3283* (2016.01)
(Continued)

(52) U.S. Cl.
CPC ..... *G09G 3/3283* (2013.01); *G09G 3/2007* (2013.01); *G09G 3/3233* (2013.01);
(Continued)

(58) Field of Classification Search
CPC .. G09G 3/3283; G09G 3/3233; G09G 3/2007; G09G 2320/045; G09G 2310/027;
(Continued)

(56) References Cited

U.S. PATENT DOCUMENTS 5,311,145 A * 5/1994 Huijsing ..... H03F 3/3028 330/255
6,501,467 B2 * 12/2002 Miyazaki ..... G09G 3/3696 345/210
(Continued)

FOREIGN PATENT DOCUMENTS

KR 10-2013-0107909 A 10/2013
KR 10-2014-0095275 A 8/2014
(Continued)

OTHER PUBLICATIONS

Chaji, et al., Stable RGBW AMOLED Display with OLED Degradation Compensation Using Electrical Feedback, ISSCC 2010 / Session 6 / Displays & Biomedical Devices / 6.3, 2010 IEEE International Solid-State Circuits Conference, pp. 118-120.
(Continued)

*Primary Examiner* — Lun-Yi Lao
*Assistant Examiner* — Kelly Hegarty
(74) *Attorney, Agent, or Firm* — Lewis Roca Rothgerber Christie LLP

(57) ABSTRACT

A data driver includes a data signal converter to convert image data to a data signal, an output buffer to output the data signal to a data line, a first cascode circuit connected to the output buffer and including a plurality of transistors, a first noise attenuator connected to a first node between the output buffer and the first cascode circuit, and to attenuate a first current noise, a second cascode circuit connected to the output buffer and including a plurality of transistors, a second noise attenuator connected a second node between
(Continued)

the output buffer and the second cascode circuit, and to attenuate a second current noise, a current integrator to generate an integrated voltage by integrating a first current flowing through the first cascode circuit and a second current flowing through the second cascade circuit, and an analog-digital converter (ADC) to convert the integrated voltage to a digital signal.

20 Claims, 13 Drawing Sheets

(51) Int. Cl.
*G09G 3/3233* (2016.01)
*G09G 3/20* (2006.01)

(52) U.S. Cl.
CPC ..... *G09G 2310/027* (2013.01); *G09G 2310/0272* (2013.01); *G09G 2310/0291* (2013.01); *G09G 2310/0294* (2013.01); *G09G 2320/045* (2013.01); *G09G 2330/021* (2013.01)

(58) Field of Classification Search
CPC ..... G09G 2330/021; G09G 2310/0272; G09G 2310/0294; G09G 2310/0291
See application file for complete search history.

(56) References Cited

U.S. PATENT DOCUMENTS 6,690,149 B2 * 2/2004 Monomoushi ..... G05F 1/56 323/297
7,652,538 B2 * 1/2010 Choi ..... H03F 1/08 330/260
8,988,402 B2 * 3/2015 Tsuchi ..... H03F 1/0261 330/253
2004/0263241 A1 * 12/2004 Fujikura ..... G05F 3/262 327/543
2004/0263502 A1 * 12/2004 Dallas ..... G02F 1/133553 345/204
2005/0030214 A1 * 2/2005 Jo ..... G09G 3/3275 341/145
2007/0194814 A1 * 8/2007 Oomori ..... G09G 3/3283 327/108
2008/0042152 A1 * 2/2008 Kawachi ..... G11C 11/412 257/89
2008/0111628 A1 * 5/2008 Tsuchi ..... G09G 3/3688 330/282
2008/0191804 A1 * 8/2008 An ..... H03F 3/3023 330/255
2008/0278473 A1 * 11/2008 An ..... H04L 25/028 345/214
2009/0244056 A1 * 10/2009 Tsuchi ..... G09G 3/3688 345/214
2010/0033464 A1 * 2/2010 Shimatani ..... H03F 3/45219 345/211
2011/0007058 A1 * 1/2011 Hisano ..... G09G 3/3688 345/211
2011/0199366 A1 * 8/2011 Tsuchi ..... G09G 3/3688 345/212

FOREIGN PATENT DOCUMENTS

KR 10-2014-0107752 A 9/2014
KR 10-2015-0020816 A 2/2015

OTHER PUBLICATIONS

In, et al., An Advanced External Compensation System for Active Matrix Organic Light-Emitting Diode Displays With Poly-Si Thin-Film Transistor Backplane, IEEE Transactions on Electron Devices, vol. 57, No. 11, Nov. 2010, pp. 3012-3019.

* cited by examiner

DATA DRIVER AND ORGANIC LIGHT EMITTING DISPLAY DEVICE HAVING THE SAME

CROSS REFERENCE TO RELATED APPLICATION

This application claims priority to, and the benefit of, Korean patent Application No. 10-2015-0084742 filed on Jun. 16, 2015, the disclosure of which is hereby incorporated by reference herein in its entirety.

BACKGROUND

1. Field

Example embodiments of the inventive concept relate to a display device. More particularly, example embodiments of the inventive concept relate to a data driver and an organic light emitting display device having the data driver.

2. Description of the Related Art

An organic light emitting diode (OLED) includes an organic layer between an anode and a cathode. Positive holes from the anode are combined in the organic layer with electrons from the cathode to induce light emission. A display made from OLED pixels has a wide viewing angle, a rapid response speed, relatively thin thickness, and low power consumption.

Over time, the performance of an OLED pixel may deteriorate. As result, luminance from the pixel may decrease. The pixels in an organic light emitting display device may degrade with differing degrees of deterioration. Various methods have been proposed to compensate for this deterioration, to thereby prevent a corresponding decrease in luminance and display quality. For example, the deterioration of a driving transistor or OLED may be sensed using an analog-digital converter (ADC) to compensate the deterioration of pixels. However, the precise varying degrees of deterioration might not be sensed accurately due to a current noise occurring in a current-sensing circuit. In addition, when the current-sensing circuits are in every channel, manufacturing costs increase, and additional space for the current-sensing circuits may be needed.

SUMMARY

Example embodiments provide a data driver capable of sensing a deterioration of pixels.

Example embodiments provide an organic light emitting display device capable of compensating the deterioration of pixels.

According to some example embodiments, a data driver may include a data signal converter configured to convert image data to a data signal, an output buffer configured to output the data signal to a data line, a first cascode circuit connected to the output buffer and including a plurality of transistors connected in series, a first noise attenuator connected to a first node between the output buffer and the first cascode circuit, and configured to attenuate a first current noise, a second cascode circuit connected to the output buffer and including a plurality of transistors connected in series, a second noise attenuator connected a second node between the output buffer and the second cascode circuit, and configured to attenuate a second current noise, a current integrator configured to generate an integrated voltage by integrating a first current flowing through the first cascode circuit and a second current flowing through the second cascode circuit, and an analog-digital converter (ADC) configured to convert the integrated voltage to a digital signal.

In a panel-driving mode the first node may be configured to be connected to a first power source, the second node may be configured to be connected to a ground source, and the current integrator may be configured to be disconnected from the first cascode circuit and the second cascode circuit.

In a first current-sensing mode, the current integrator may be configured to be connected to the first cascode circuit, and may be configured to be disconnected from the second cascode circuit.

In a second current-sensing mode, the current integrator may be configured to be connected to the second cascode circuit, and may be configured to be disconnected from the first cascode circuit.

The output buffer may include a first amplifier, a first output transistor, and a second output transistor; the first amplifier may include a first input terminal for receiving the data signal from the data signal converter, a second input terminal connected to a third node, and an output terminal connected to a gate electrode of the first output transistor and to a gate electrode of the second output transistor; the first output transistor may be include the gate electrode connected to the output terminal of the first amplifier, a first electrode connected to the first node, and a second electrode connected to the third node; and the second output transistor may include the gate electrode connected to the output terminal of the first amplifier, a first electrode connected to the third node, and a second electrode connected to the second node.

The first cascode circuit may include a first cascode transistor and a second cascode transistor; the first cascode transistor may include a gate electrode connected to a first bias power source, a first electrode connected to a second electrode of the second cascode transistor, and a second electrode connected to the first node; and the second cascode transistor may include a gate electrode connected to a first power source, a first electrode connected to the current integrator via a first switch, and the second electrode connected to the first electrode of the first cascode transistor.

The first noise attenuator may include a first filtering capacitor connected between the first node and a ground source.

The first noise attenuator may include a first filtering capacitor connected between the first node and a common source amplifier.

The second cascode circuit may include a third cascode transistor and a fourth cascode transistor; the third cascode transistor may include a gate electrode connected to a second bias power source, a first electrode connected to the second node, and a second electrode connected to a first electrode of the fourth cascode transistor; and the fourth cascode transistor may include a gate electrode connected to a ground source, the first electrode connected to the second electrode of the third cascode transistor, and a second electrode connected to the current integrator via a second switch.

The second noise attenuator may include a second filtering capacitor connected between the second node and a ground source.

The second noise attenuator may include a second filtering capacitor connected between the second node and a common source amplifier.

The current integrator may include a first integrating capacitor, a second integrating capacitor, and a second amplifier; the first integrating capacitor may be connected between a first input terminal of the second amplifier and a current input node through which the first current and the second current are configured to flow, the second amplifier may include the first input terminal connected to the first integrating capacitor, a second input terminal connected to a reference source, and an output terminal connected to the ADC; and the second integrating capacitor may be connected between the current input node and the output terminal of the second amplifier.

The current input node may be configured to be periodically connected to a first power source or to a ground source by a first initialization switch; and the first input terminal of the second amplifier may be configured to be periodically connected to the output terminal of the second amplifier by a second initialization switch.

The first initialization switch and the second initialization switch may be configured to be turned on at substantially a same time; and the first initialization switch may be configured to be turned off earlier than when the second initialization switch is turned off.

The ADC may be a second order sigma-delta ADC.

According to some example embodiments, an organic light emitting display device may include a display panel including a plurality of pixels, a scan driver configured to provide a scan signal to the pixels via scan lines, a data driver configured to provide a data signal to the pixels via data lines in a panel-driving mode, configured to derive a first deterioration data for organic light emitting diodes in the pixels in a first current-sensing mode, and configured to derive a second deterioration data for driving transistors in the pixels in a second current-sensing mode, and a controller configured to control the scan driver and the data driver to display an image based on the first deterioration data and the second deterioration data, wherein the data driver includes a data signal converter configured to convert image data to the data signal, an output buffer configured to output the data signal to the data line, a first cascode circuit connected to the output buffer, and comprising a plurality of transistors connected in series, a first noise attenuator connected to a first node between the output buffer and the first cascode circuit, and configured to attenuate a first current noise, a second cascode circuit connected to the output buffer, and including a plurality of transistors connected in series, a second noise attenuator connected a second node between the output buffer and the second cascode circuit, and configured to attenuate a second current noise, a current integrator configured to generate an integrated voltage by integrating a first current flowing through the first cascode circuit and a second current flowing through the second cascode circuit, and an analog-digital converter (ADC) configured to convert the integrated voltage to a digital signal.

In the panel-driving mode, the first node may be configured to be connected to a first power source, the second node may be configured to be connected to a ground source, and the current integrator may be configured to be disconnected from the first cascode circuit and the second cascade circuit.

In the first current-sensing mode, the current integrator may be configured to be connected to the first cascode circuit and may be configured to be disconnected from the second cascode circuit.

In the second current-sensing mode, the current integrator may be configured to be connected to the second cascode circuit and may be configured to be disconnected from the first cascode circuit.

In the second current-sensing mode, the data signal converter may be configured to generate the data signal corresponding to a voltage of an anode electrode of the organic light emitting diodes.

Therefore, the data driver according to example embodiments can decrease current noise when the current is sensed, and can accurately sense a deterioration of pixels. Further, the data driver can be implemented in a relatively small space because a driving circuit for driving the display panel, and a sensing circuit for measuring the deterioration of the pixels, are included in one integrated circuit (IC) chip. Accordingly, the ADCs can be in every channel, and the deterioration of the pixels may be sensed at a high speed.

In addition, the organic light emitting display device according to example embodiments can compensate the deterioration of the pixels, and can increase the display quality by including the data driver.

BRIEF DESCRIPTION OF THE DRAWINGS

Exemplary embodiments will be described more fully hereinafter with reference to the accompanying drawings, in which various embodiments are shown.

DESCRIPTION OF EMBODIMENTS

Figure 1:
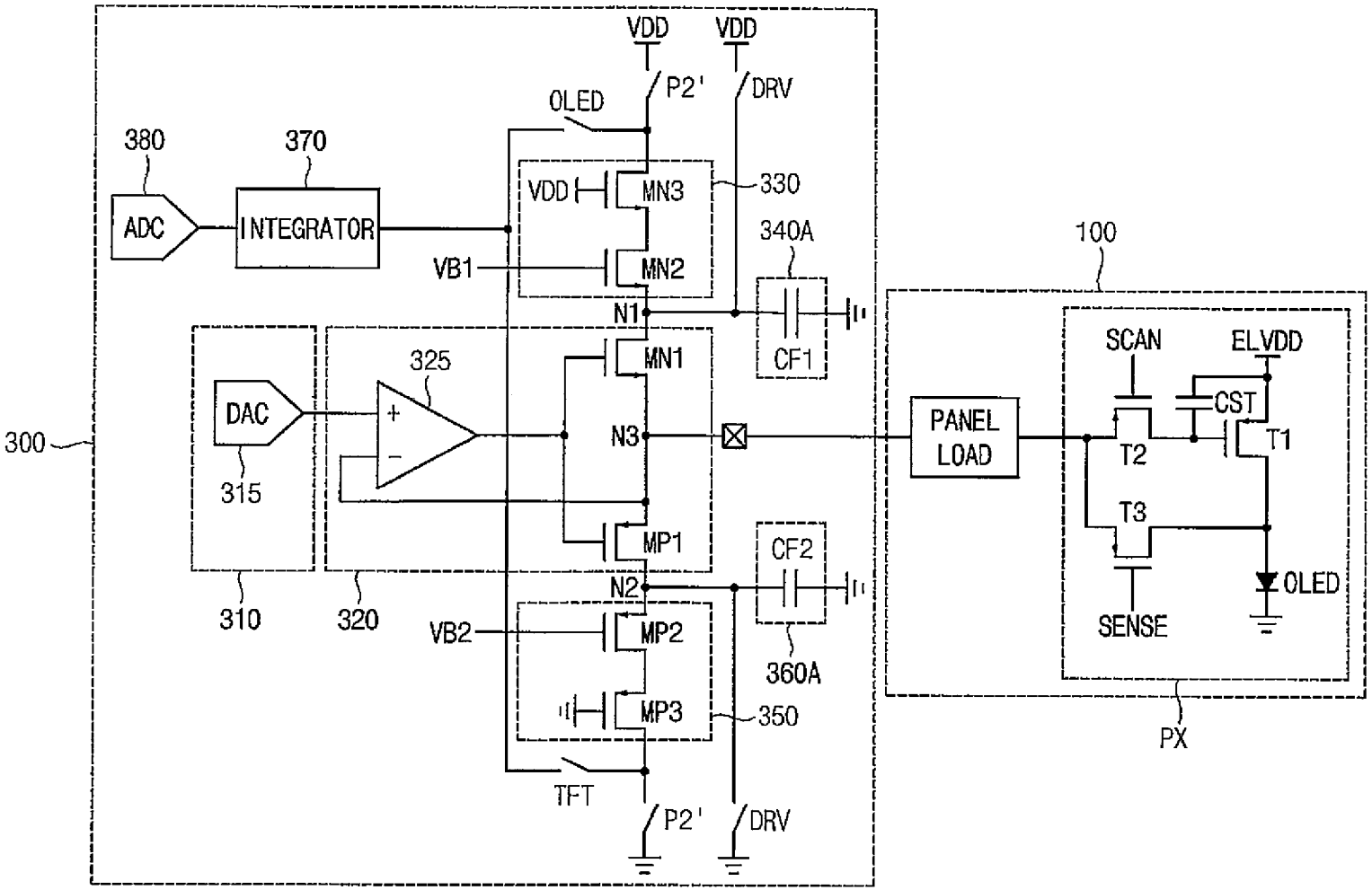
FIG. 1 is a circuit diagram illustrating a data driver and a display panel according to one example embodiment.

Features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features, of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Exemplary embodiments will be described more fully hereinafter with reference to the accompanying drawings, in which various embodiments are shown.

FIG. 1 is a circuit diagram illustrating a data driver and a display panel according to one example embodiment.

Referring to FIG. 1, the data driver 300 may include a data signal converter 310, an output buffer 320, a first cascode circuit 330, a first noise attenuator 340A, a second cascode circuit 350, a second noise attenuator 360A, a current integrator 370, and an analog-digital converter (ADC) 380.

The data signal converter 310 may generate a data signal from image data using a digital-analog converter (DAC). In one example embodiment, the data signal converter 310 may include a shift register, a sampling latch, a holding latch, and DAC 315. The shift register may supply sampling signals to the sampling latch. For example, a plurality of shift registers may shift a start pulse every one period of a shift clock, thereby sequentially supplying m (m is a natural number) sampling signals to the sampling latch. The sampling latch may store the image data in response to the sampling signals. The holding latch may receive the image data from the sampling latch, and may store the image data in response to the output enable signal. In addition, the holding latch may supply the stored image data to the DAC 315. The DAC 315 may generate an analog voltage (i.e., the data signal) corresponding to the image data. Here, the DAC 315 may control the voltage of the data signal, corresponding to a bit value of the image data, so as to implement gray levels.

The output buffer 320 may output the data signal to a data line, and may be located in each output channel in the data driver 300. The output buffer 320 may receive the data signal from the data signal converter 310, and may output the data signal to the data line. In one example embodiment, the output buffer 320 may include a first amplifier 325, a first output transistor MN1, and a second output transistor MP1. The first amplifier 325 may include a first input terminal for receiving the data signal from the data signal converter 310, a second input terminal connected to a third node N3, and an output terminal connected to a gate electrode of the first output transistor MN1 and connected to a gate electrode of the second output transistor MP1. The first output transistor MN1 may include the gate electrode connected to the output terminal of the first amplifier 325, a first electrode connected to a first node N1, and a second electrode connected to the third node N3. The second output transistor MP1 may include the gate electrode connected to the output terminal of the first amplifier 325, a first electrode connected to the third node N3, and a second electrode connected to a second node N2. Thus, the first amplifier 325, the first output transistor MN1, and the second output transistor MP1 in the output buffer 320 form a negative feedback loop to perform a role as the buffer amplifier.

The first cascode circuit 330 may be connected to the output buffer 320, and may include a plurality of transistors that are connected in series. In a first current-sensing mode for deriving a first deterioration data of the OLED in the pixel PX, the first current may flow through the first cascode circuit 330. The first cascode circuit 330 may decrease an effect a voltage change has on the first current by increasing output impedance. In one example embodiment, the first cascode circuit 330 may include a first cascode transistor MN2 and a second cascode transistor MN3. The first cascode transistor MN2 may include a gate electrode connected to a first bias power source VB1, a first electrode connected to a second electrode of the second cascode transistor MN3, and a second electrode connected to the first node N1. The second cascode transistor MN3 may include a gate electrode connected to a first power source VDD, a first electrode connected to the current integrator 370 via a first switch, and the second electrode connected to the first electrode of the first cascode transistor MN2.

The first noise attenuator 340A may be connected the first node N1, which is between the output buffer 320 and the first cascode circuit 330, and may attenuate a current noise. In one example embodiment, the first noise attenuator 340A may include a first filtering capacitor CF1 connected between the first node N1 and a ground source. The first filtering capacitor CF1 may form a current through filter with the first cascode transistor MN2 to thereby decrease the current noise.

The second cascode circuit 350 may be connected to the output buffer 320, and may include a plurality of transistors that are connected in series. In a second current-sensing mode for deriving a second deterioration data of the driving transistor in the pixel PX, a second current may flow through the second cascode circuit 350. The second cascode circuit 350 may decrease an effect a voltage change has on the second current by increasing output impedance. In one example embodiment, the second cascode circuit 350 may include a third cascode transistor MP2 and a fourth cascode transistor MP3. The third cascode transistor MP2 may include a gate electrode connected to a second bias power source VB2, a first electrode connected to the second node N2, and a second electrode connected to a first electrode of the fourth cascode transistor MP3. The fourth cascode transistor MP3 may include a gate electrode connected to a ground source, the first electrode connected to the second electrode of the third cascode transistor MP2, and a second electrode connected to the current integrator 370 via a second switch.

The second noise attenuator 360A may be connected the second node N2, which is located between the output buffer 320 and the second cascode circuit 350, and may attenuate a current noise. In one example embodiment, the second noise attenuator 360A may include a second filtering capacitor CF2 connected between the second node N2 and the ground source. The second filtering capacitor CF2 may form a current through filter with the third cascode transistor MP2 to decrease the current noise.

The current integrator 370 may integrate the first current, which flows through the first cascode circuit 330, and the second current, which flows through the second cascode circuit 350, to thereby generate an integrated voltage. For example, the current integrator 370 may generate the integrated voltage by integrating the first current flowing through the OLED in the pixel PX in the first current-sensing mode, and by integrating the second current flowing through the driving transistor (e.g., thin film transistor (TFT)) in the pixel PX in the second current-sensing mode.

The analog-digital converter (ADC) 380 may convert the integrated voltage to a digital signal. The ADC 380 may derive the first deterioration data of the OLED by converting the integrated voltage to the digital signal in the first current-sensing mode. In addition, the ADC 380 may derive the second deterioration data (e.g., threshold voltage and mobility of the driving transistor) of the driving transistor by converting the integrated voltage to the digital signal in the second current-sensing mode.

The display panel 100 may include a plurality of pixels PX. Each pixel PX may include the OLED and a pixel circuit. An anode electrode of the OLED may be connected to the pixel circuit, and a cathode electrode of the OLED may be connected to the ground source. The OLED may emit the light based on a driving current supplied from the pixel circuit. The pixel circuit may receive the data signal in response to the scan signal from the scan line. Also, the pixel circuit may receive the first current from the data driver 300, or may provide the second current to the data driver 300 in response to the sensing signal to generate the first deterioration data and the second deterioration data.

In one example embodiment, the pixel circuit may include a first transistor T1, a second transistor T2, a third transistor T3, and a storage capacitor CST.

The second transistor T2 may include a gate electrode connected to the scan line, a first electrode connected to the data line, and a second electrode connected to a first electrode of the storage capacitor CST. The second transistor T2 may be turned on in response to the scan signal. The scan signal may be applied while a voltage corresponding to the data signal is charged in the storage capacitor CST.

The first transistor T1 may be the driving transistor, and may include a gate electrode connected to the first electrode of the storage capacitor CST, a first electrode connected to a second electrode of the storage capacitor CST and connected to a high power source ELVDD, and a second electrode connected to the anode electrode of the OLED. The first transistor T1 may control the driving current flowing from the high power source ELVDD to the OLED based on the voltage stored in the storage capacitor CST.

The third transistor T3 may include a gate electrode connected to the sensing line, a first electrode connected to the second electrode of the first transistor T1 and connected to the anode electrode of the OLED, and a second electrode connected to the data line. The third transistor T3 may be turned on in response to the sensing signal SENSE. The sensing signal SENSE may be supplied in the sensing mode.

Although the example embodiments of FIG. 1 describe that the pixel circuit includes the first through third transistors T1 through T3 and the storage capacitor CST, the pixel circuit is not limited thereto.

Figure 2:
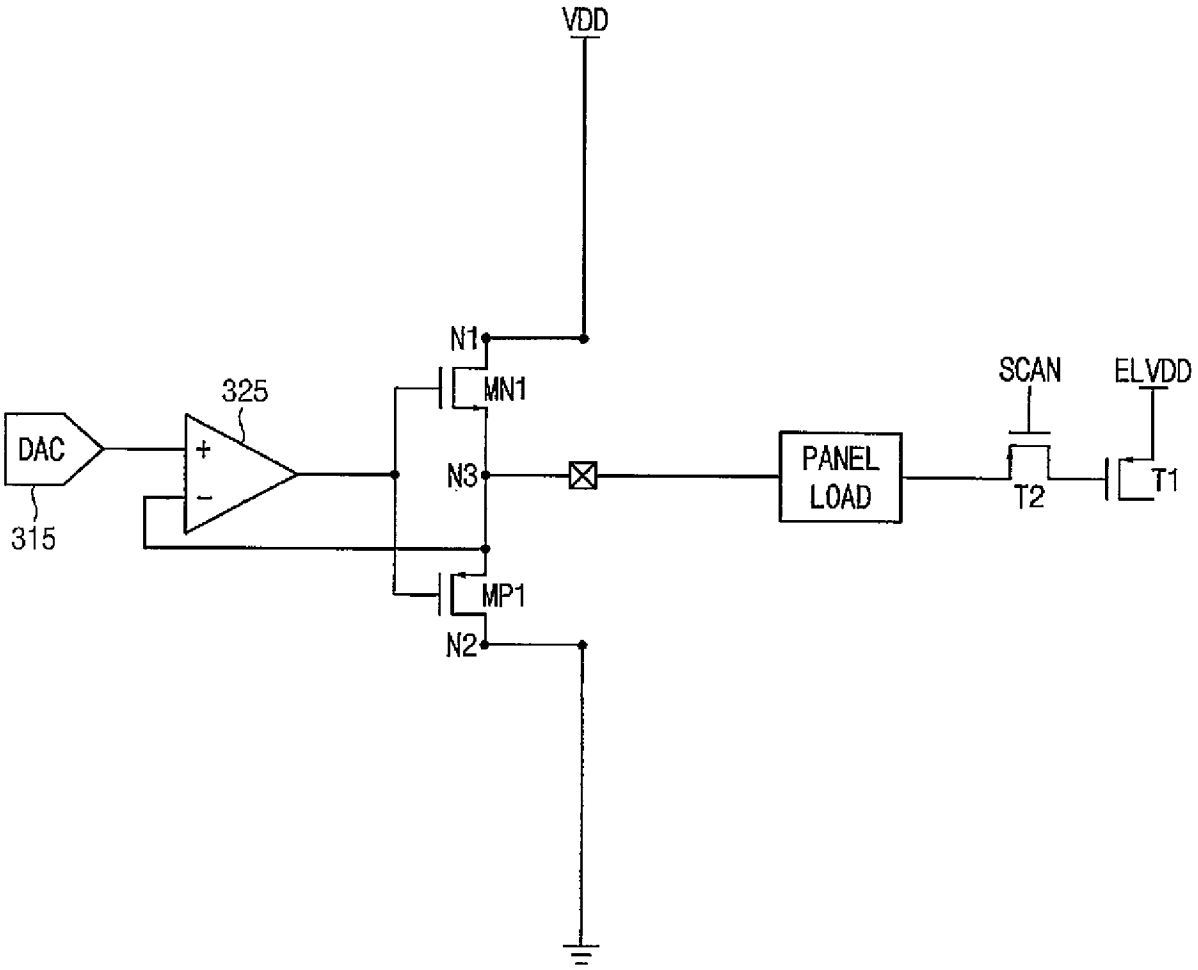
FIG. 2 is a circuit diagram illustrating a data driver of FIG. 1 that is configured to drive the display panel in a panel-driving mode.

FIG. 2 is a circuit diagram illustrating a data driver of FIG. 1 that is configured to drive the display panel in a panel-driving mode.

Referring to FIG. 2, the data driver may output a data signal to a data line to write the data signal to a pixel in a panel-driving mode.

In the panel-driving mode, a first node N1 may be connected to a first power source VDD, and a second node N2 may be connected to a ground source. A current integrator 370 may be disconnected from a first cascode circuit 330 and disconnected from a second cascode circuit 350 in the panel-driving mode. Therefore, a first output transistor MN1 may be connected to the first power source VDD, and a second output transistor MP1 may be connected to the ground source. Accordingly, a DAC 315, a first amplifier 325, the first output transistor MN1, and the second output transistor MP1 may form a negative feedback loop to perform a role as the buffer amplifier.

In addition, in the panel-driving mode, a scan signal SCAN may be applied to the pixel, and the data signal may be applied to the storage capacitor CST and to the gate electrode of the first transistor T1. Therefore, an OLED may emit the light based on a driving current provided from the pixel circuit in the panel-driving mode.

Figure 3:
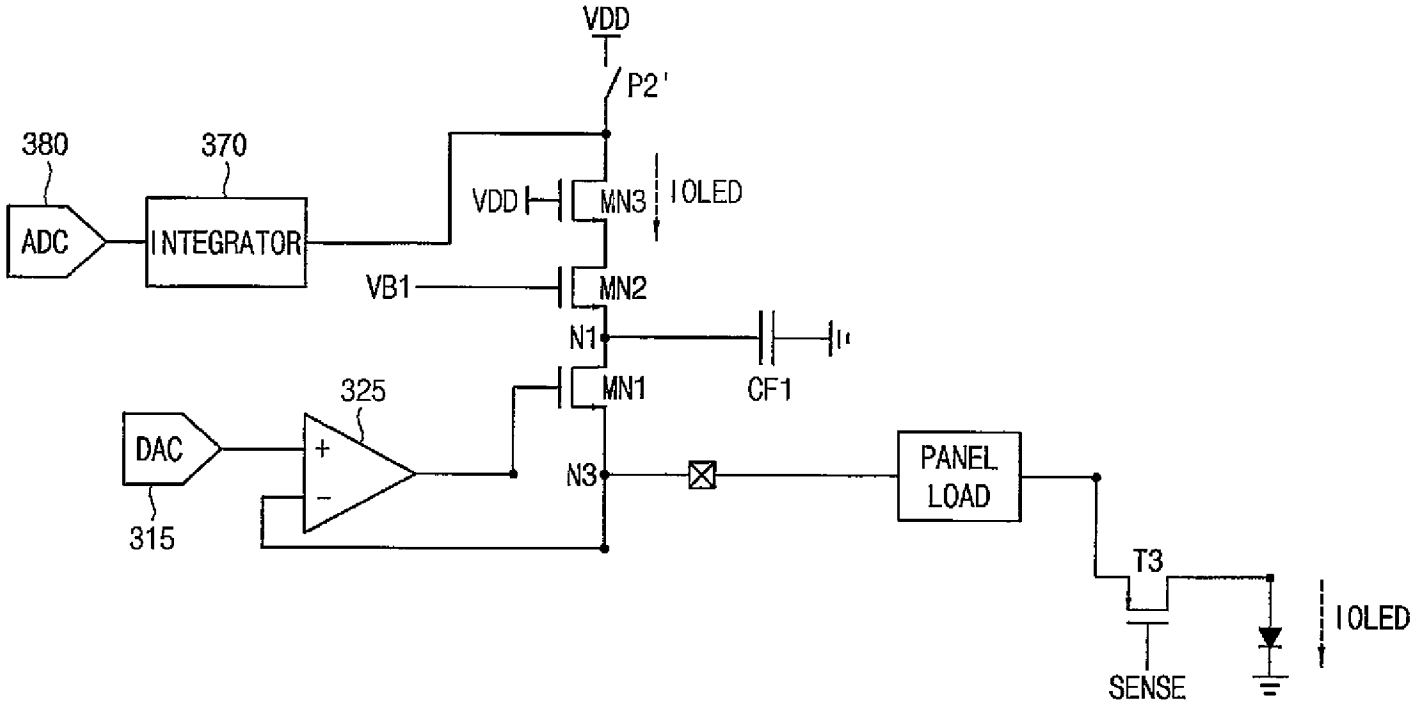
FIG. 3 is a circuit diagram illustrating a data driver of FIG. 1 that is configured to sense a deterioration of an OLED in a first current-sensing mode.

FIG. 3 is a circuit diagram illustrating a data driver of FIG. 1 that is configured to sense a deterioration of an OLED in a first current-sensing mode.

Referring to FIG. 3, in the first current-sensing mode, a current integrator 370 may generate an integrated voltage by integrating a first current IOLED flowing through a first cascode circuit 330 to derive the first deterioration data for the OLED.

The current integrator 370 may be connected to a first cascode circuit 330, and may be disconnected from a second cascode circuit 350, in the first current-sensing mode.

The current can flow through one of the first output transistor MN1 or the second output transistor MP1 according to a direction of the current, because a voltage of the gate electrode of the first output transistor MN1 may be substantially the same as a voltage of the gate electrode of the second output transistor MP1. Therefore, the first current IOLED may flow to the OLED through the current integrator 370, through the first cascode circuit 330, and through the first output transistor MN1. In one example embodiment, to decrease a current variation by a channel length modulation, an output buffer 320 may output a data signal corresponding to a voltage of the anode electrode of the OLED in the first current-sensing mode. A voltage of the first electrode of the second cascode transistor MN3 may be changed while the current integrator 370 is operating. The first cascode transistor MN2 and the second cascode transistor MN3 may decrease the effect a voltage variation of the first electrode of the second cascode transistor MN3 has on the first current IOLED by increasing output impedance.

Figure 4:
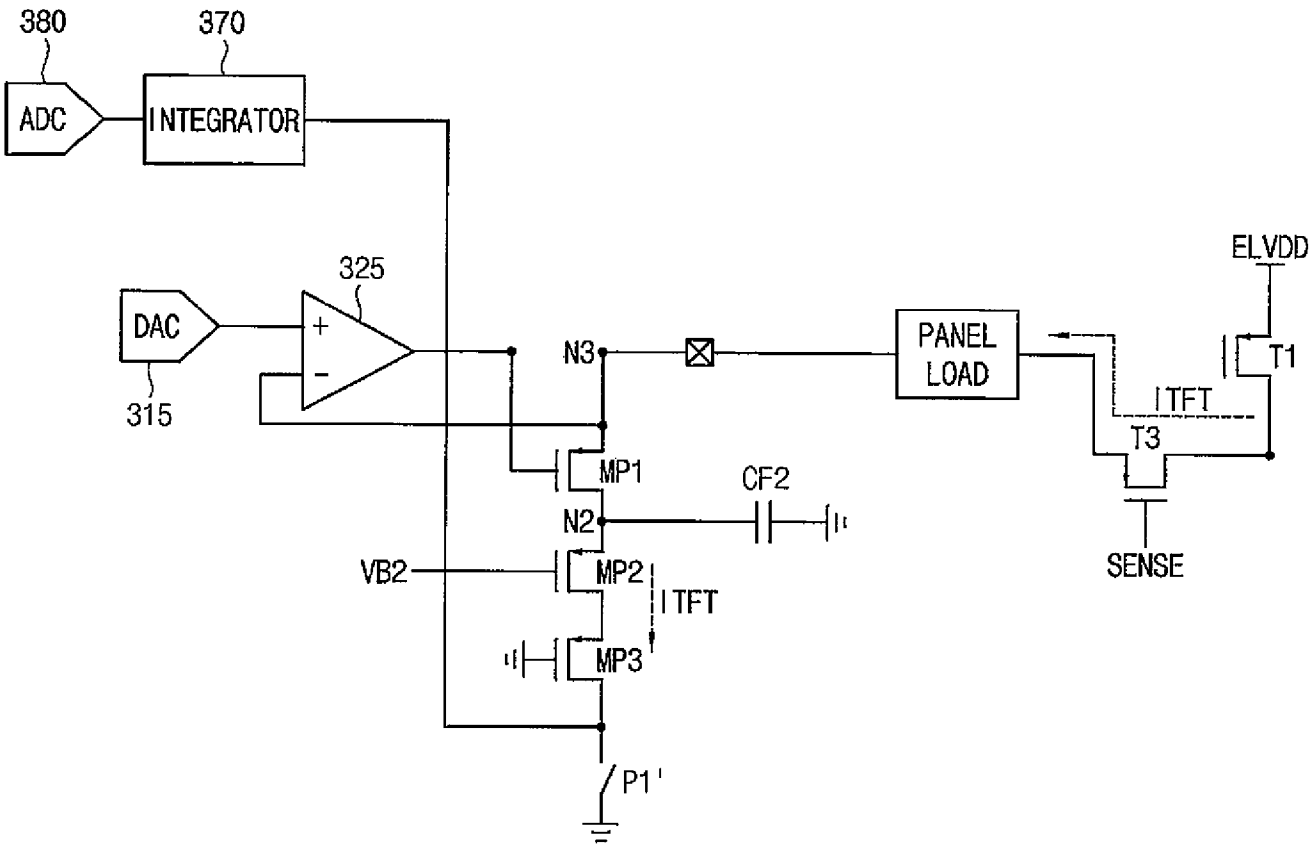
FIG. 4 is a circuit diagram illustrating a data driver of FIG. 1 that is configured to sense a deterioration of a driving transistor in a second current-sensing mode.

FIG. 4 is a circuit diagram illustrating a data driver of FIG. 1 that is configured to sense a deterioration of a driving transistor in a second current-sensing mode.

Referring to FIG. 4, in the second current-sensing mode, a current integrator 370 may generate an integrated voltage by integrating a second current ITFT flowing through a second cascade circuit 350 to derive the second deterioration data for a first transistor T1 (i.e., driving transistor).

The current integrator 370 may be connected to the second cascode circuit 350, and may be disconnected from a first cascode circuit 330, in the second current-sensing mode.

When a target data signal is applied to a gate electrode of a first transistor T1 while a sensing signal SENSE is applied to a third transistor T3, the second current ITFT may flow to the data driver via a data line. The current can flow through one of a first output transistor MN1 or a second output transistor MP1 according to a direction of the current, because a voltage of the gate electrode of the first output transistor MN1 is substantially the same as a voltage of the gate electrode of the second output transistor MP1. Therefore, the second current ITFT may flow to the current integrator 370 through the first transistor T1, through the second output transistor MP1, and through the second cascode circuit 350. To decrease current variation by a channel length modulation, an output buffer 320 may output a data signal corresponding to a voltage of the anode electrode of the OLED. A voltage of a second electrode of a fourth cascode transistor MP3 may be changed while the current integrator 370 is operating. The third cascode transistor MP2 and the fourth cascode transistor MP3 may decrease the effect a voltage variation of the second electrode of the fourth cascode transistor MP3 has on the second current ITFT by increasing output impedance.

Figure 5:
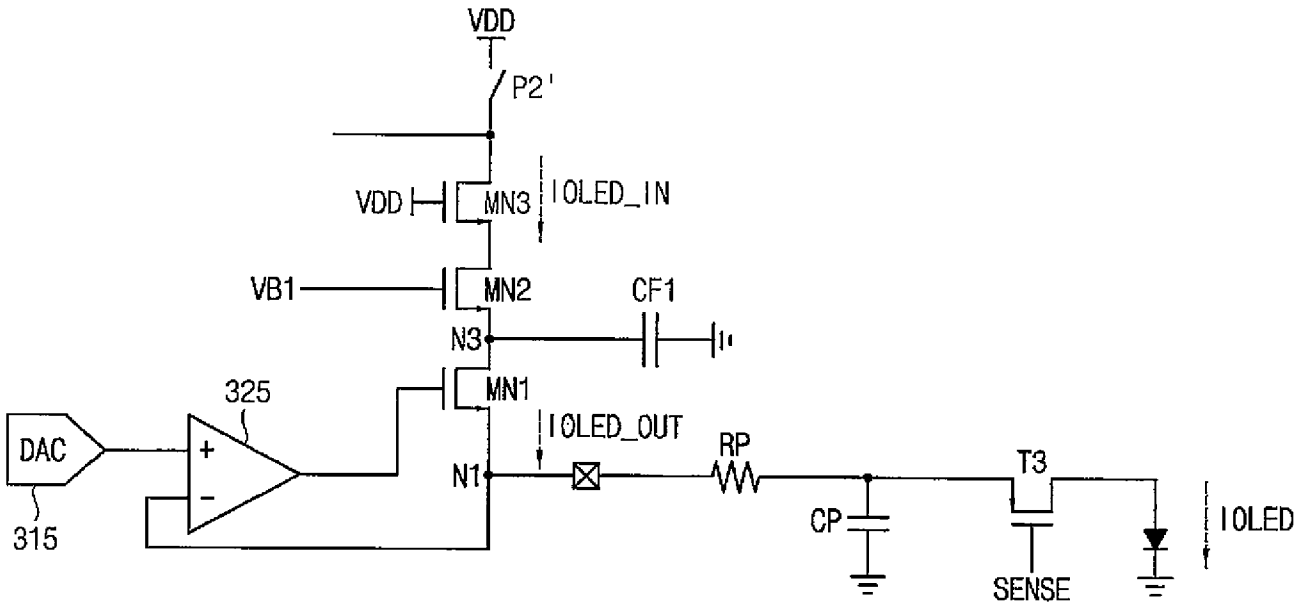
FIG. 5 is a diagram for describing a current noise in a data driver of FIG. 1.
Figure 6A:
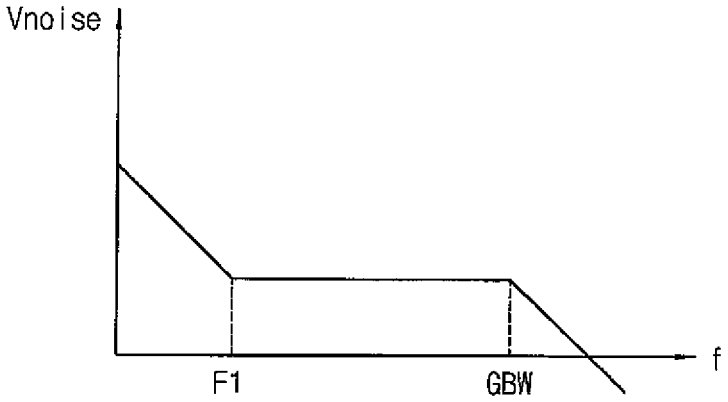
FIGS. 6A through 6C are graphs for describing a current noise in a data driver not including a noise attenuator.
Figure 6B:
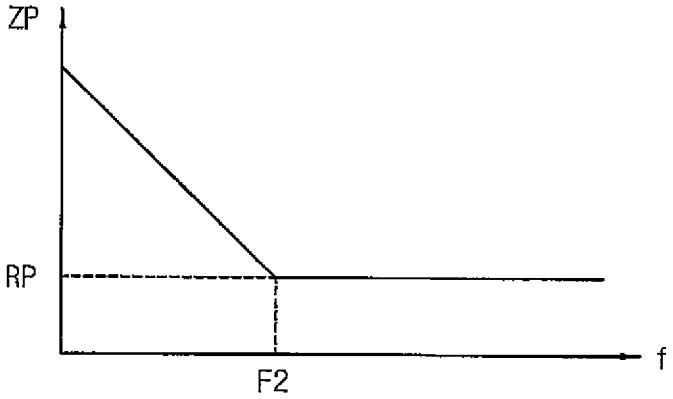
Figure 6C:
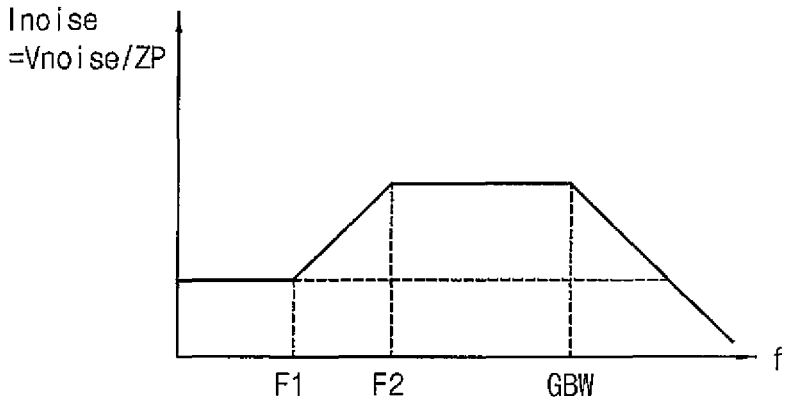
Figure 7A:
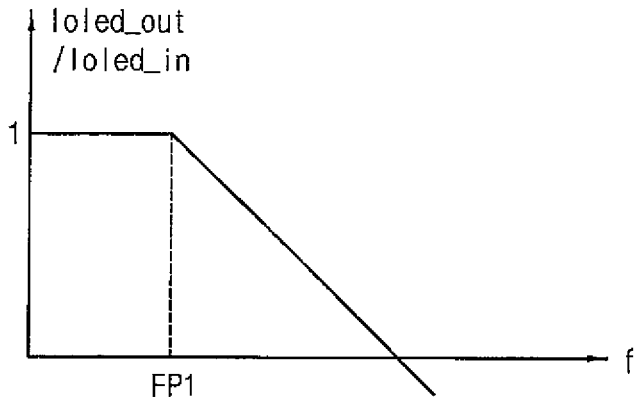
FIGS. 7A and 7B are graphs for describing a current noise in a data driver of FIG. 1.
Figure 7B:
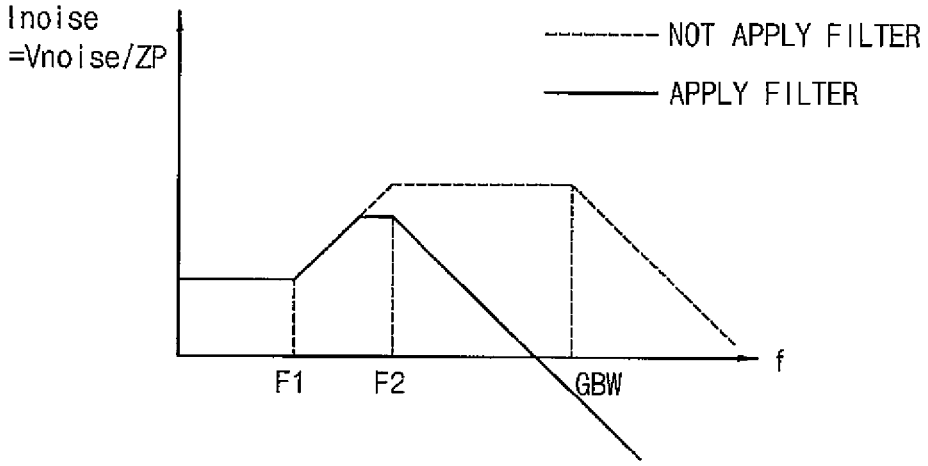

FIG. 5 is a diagram for describing a current noise in a data driver of FIG. 1, FIGS. 6A through 6C are graphs for describing a current noise in a data driver not including a noise attenuator, and FIGS. 7A and 7B are graphs for describing a current noise in a data driver of FIG. 1.

Referring to FIGS. 5 through 7B, the data driver may decrease a current noise occurring when a first current is sensed by including a first cascode circuit and a first noise attenuator. In addition, the data driver may decrease a current noise occurring when a second current is sensed by including a second cascode circuit and a second noise attenuator. Because an operation principle of the first cascode circuit and the first noise attenuator for decreasing the current noise is substantially the same as an operation principle of the second cascode circuit and the second noise attenuator, duplicated descriptions will be omitted.

As shown in FIG. 5, when the first current IOLED is sensed, a voltage noise Vnoise occurring in the first output transistor MN1 may be converted to the current noise Inoise according to an impedance ZP of a load resistance RP and a load capacitance CP (i.e., a panel load). Here, a magnitude of the current noise Inoise may be calculated as "the voltage noise Vnoise/the impedance ZP of the panel load." A signal to noise ratio (SNR) for the first current IOLED may decrease because the first current IOLED is affected by the current noise Inoise.

As shown in FIG. 6A, in a low frequency band of which frequency is smaller than a first frequency F1, the voltage noise Vnoise may be relatively high. The voltage noise Vnoise may decrease as the frequency increase by a flicker noise (1/f) in the low frequency band. In a band of which frequency is between the first frequency F1 and a bandwidth GBW of a first amplifier, the voltage noise Vnoise may be maintained at a same level regardless of a magnitude of the frequency by a constant thermal noise. Also, in a band of which frequency is larger than the bandwidth GBW of the first amplifier, the voltage noise Vnoise may decrease as the frequency increase because the voltage noise Vnoise is attenuated by a negative feedback loop.

As shown in FIG. 6B, the impedance ZP of the panel load may decrease as the frequency increases because of the load capacitance CP. Also, the impedance ZP of the panel load may be maintained at a same level (i.e., may be maintained at the load resistance RP) regardless of the magnitude of the frequency in a band of which frequency is larger than a second frequency F2. Here, the second frequency F2 may be calculated according to the following Equation 1:

$$F2 = \frac{1}{2\pi \cdot RP \cdot CP} \quad \text{Equation 1}$$

where F2 is the second frequency, RP is a magnitude of the load resistance, and CP is a magnitude of the load capacitance.

As shown in FIG. 6C, the current noise Inoise may be calculated by dividing the voltage noise Vnoise by the impedance ZP of the panel load. The voltage noise Vnoise and the impedance ZP of the panel load may be changed according to the frequency. Therefore, in the data driver not including the first cascode circuit and the first noise attenuator, the current noise Inoise may be relatively large in the band of which frequency is between the second frequency F2 and a bandwidth of a first amplifier GBW.

As shown in FIGS. 7A and 7B, the data driver may include the first cascade circuit and the first noise attenuator, and a current low pass filter may be formed by the first filtering capacitor and an input impedance of the first cascade transistor. Here, because the input impedance of the first cascode transistor is $1/g_{MN2}$, where $g_{MN2}$ is a transconductance of the first cascode transistor, the cutoff frequency FP1 of the current low pass filter may be calculated according to the following Equation 2:

$$FP1 = \frac{g_{MN2}}{2\pi \cdot CF} \quad \text{Equation 2}$$

where FP1 is the cutoff frequency of the current low pass filter, $g_{MN2}$ is the transconductance of the first cascode transistor, and CF is the capacitance of the first filtering capacitor.

Figure 8:
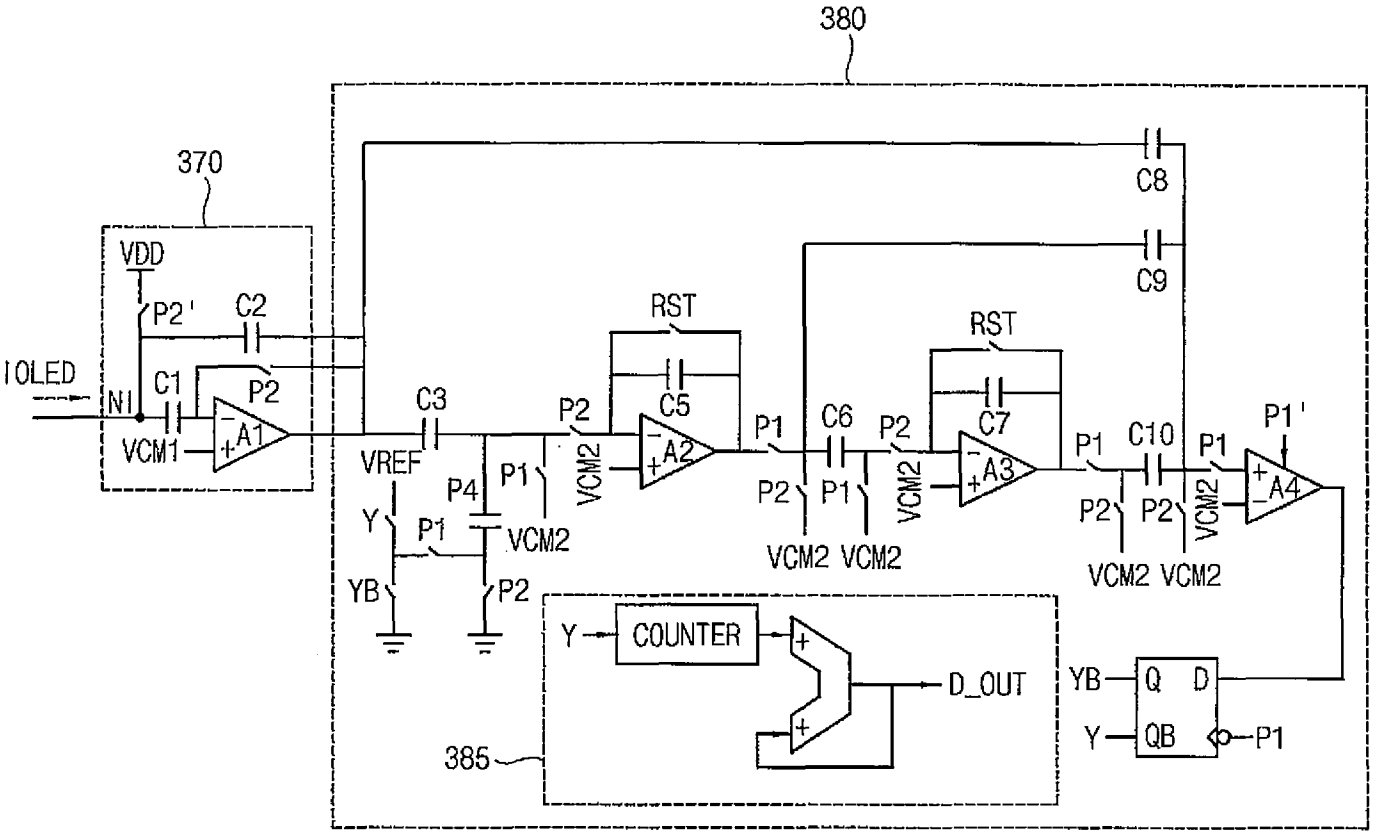
FIG. 8 is a circuit diagram illustrating an example of a current integrator and an ADC included in a data driver of FIG. 1.
Figure 9:
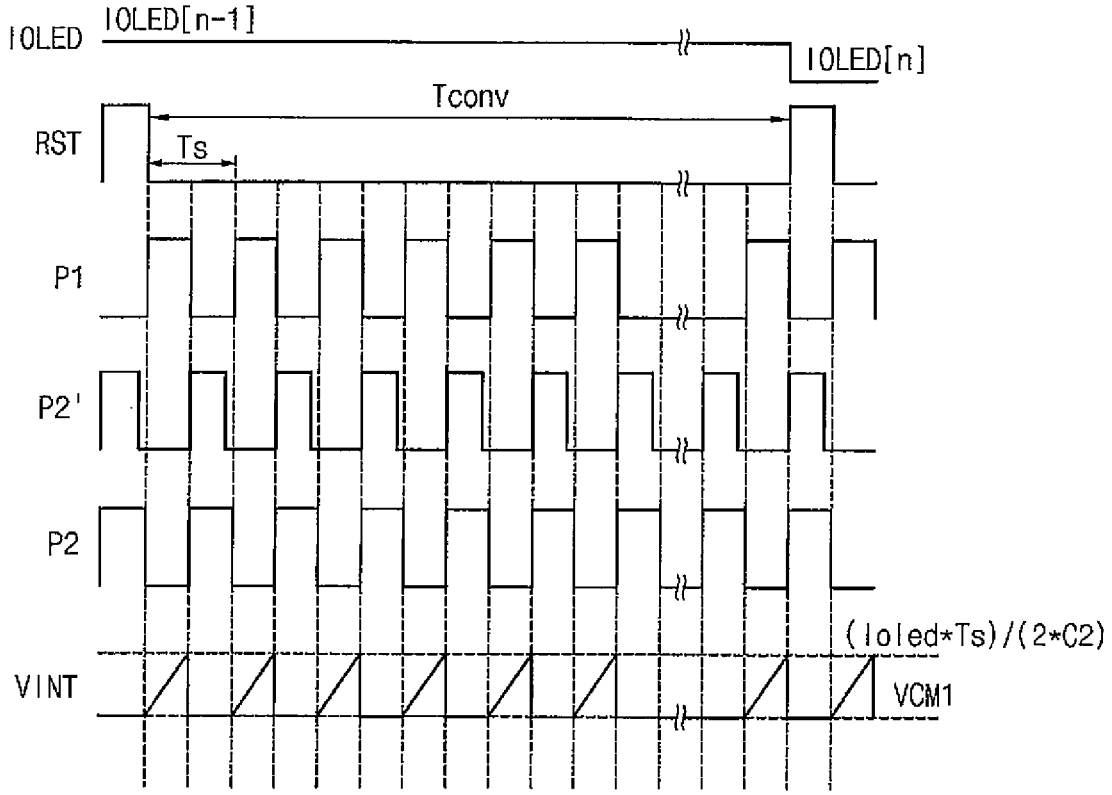
FIG. 9 is a waveform illustrating signals applied to a current integrator and an ADC of FIG. 8.

Therefore, when the cutoff frequency FP1 of the current low pass filter is smaller than the second frequency F2 in which the current noise Inoise has maximum value, the current noise can be effectively attenuated by the current low pass filter FIG. 8 is a circuit diagram illustrating an example of a current integrator and an ADC included in a data driver of FIG. 1, and FIG. 9 is a waveform illustrating signals applied to a current integrator and an ADC of FIG. 8.

Referring to FIGS. 8 and 9, the data driver including a current integrator 370 and an ADC 380 may generate an integrated voltage by integrating a first current and a second current for sensing a deterioration of the pixel, and may convert the integrated voltage to the digital signal.

The current integrator 370 may integrate the first current flowing through the first cascode circuit and the second current flowing through the second cascode circuit to generate an integrated voltage. In one example embodiment, the current integrator 370 may include a first integrating capacitor C1, a second integrating capacitor C2, and a second amplifier A1.

The first integrating capacitor C1 is connected between a current input node NI, through which the first current and the second current flow, and a first input terminal of the second amplifier A1. The second amplifier A1 may include the first input terminal connected to the first integrating capacitor C1, a second input terminal connected to a reference source VCM1, and an output terminal connected to the ADC 380. The second integrating capacitor C2 may be connected between the current input node NI and the output terminal of the second amplifier A1. The current integrator 370 may separate the current input node NI from the first input terminal of the second amplifier A1 by the first integrating capacitor C1. The current integrator 370 and the ADC 380 can use a relatively low power voltage in comparison with driving circuits for driving the display panel, thereby reducing the power consumption.

In one example embodiment, the current input node NI may be periodically connected to a first power source VDD or to a ground source by a first initialization switch. For example, the current input node NI may be periodically connected to the first power source VDD in the first current-sensing mode. Also, the current input node NI may be periodically connected to the ground source in the second current-sensing mode. The first input terminal of the second amplifier A1 may be periodically connected to the output terminal of the second amplifier A1 by a second initialization switch. The current integrator 370 can be initialized by turning on switches controlled by the (2)nd and (2')nd switching signals P2 and P2' during one half of one sampling period Ts. In addition, the current integrator 370 may integrate the current flowing out from the current integrator 370, or the current flowing into the current integrator 370, and may charge the second integrating capacitor C2 during another half of one sampling period Ts.

In one example embodiment, the first initialization switch and the second initialization switch may be turned on at substantially the same time, and the first initialization switch may be turned off earlier than the second initialization switch is turned off. Thus, the first initialization switch controlled by the (2')nd switching signal P2' may be turned off before the second initialization switch controlled by the (2)nd switching signal P2 is turned off. The current integrator 370 may be initialized when the first initialization switch is turned off while the second initialization switch is turned on. Therefore, error may be avoided by integrating a clock feedthrough of the first initialization switch in the second integrating capacitor C2.

The current integrator 370 may output the integrated voltage by repeatedly performing the integration operation and the reset operation every sampling period Ts. Here, a peak voltage of the integrated voltage VINT can be calculated according to the following Equation 3:

$$Vint = \frac{Ioled \cdot Ts}{2 \cdot C2} \quad \text{Equation 3}$$

where Vint is the peak voltage of the integrated voltage, baled is a magnitude of the first current, Ts is the sampling period, and C2 is a capacitance of the second integrating capacitor. Therefore, the peak voltage of the integrated voltage VINT may be proportional to the magnitude of the first current Ioled The ADC 380 may convert the integrated voltage VINT to a digital signal. The ADC 380 may sample the integrated voltage VINT outputted from the current integrator 370 every sampling period TS to convert the integrated voltage VINT. In one example embodiment, the ADC 380 may be a second order sigma-delta ADC. For example, the ADC 380 may include two integrators, including a third amplifier A2 and a fourth amplifier A3, respectively. The ADC 380 may have high signal-to-noise ratio (SNR) by a noise-shaping operation and an oversampling operation. The two integrators and a second order digital filter may be initialized in an initialization period in which an initialization switching signal RST is at a high level. The integrated voltage may be sampled every sampling period Ts during a converting period Tconv. An output value Y of a sigma modulator may be passed through the digital filter. Accordingly, the digital output corresponding to the integrated voltage VINT may be derived. Here, because the SNR may increase as a ratio of the converting period Tconv to the sampling period Ts (i.e., an oversampling ratio=Tconv/Ts) increases, the converting period Tconv may be determined based on a target SNR.

Although the example embodiment of FIG. 8 describes that the ADC 380 is the sigma-delta ADC including two integrators, the comparator, and the second order digital filter, the ADC 380 is not limited thereto.

Figure 10:
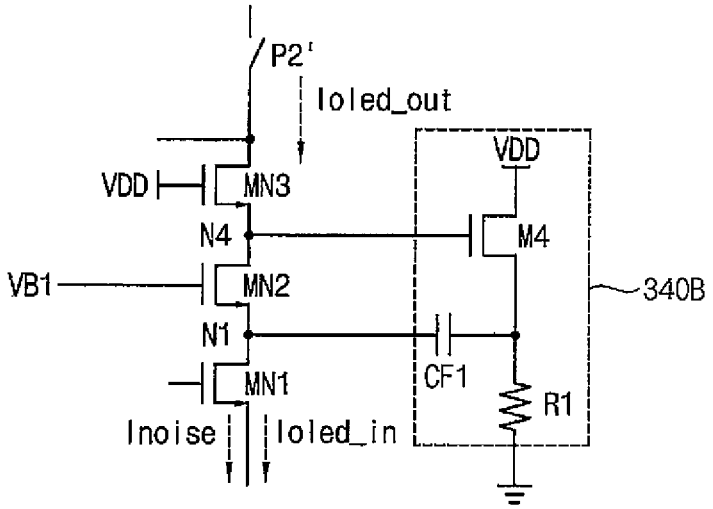
FIG. 10 is a circuit diagram illustrating another example of a noise attenuator.
Figure 11A:
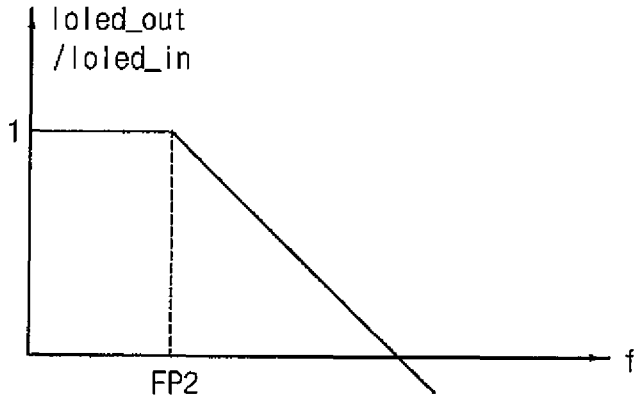
FIGS. 11A and 11B are graphs for describing an effect of a noise attenuator of FIG. 10.
Figure 11B:
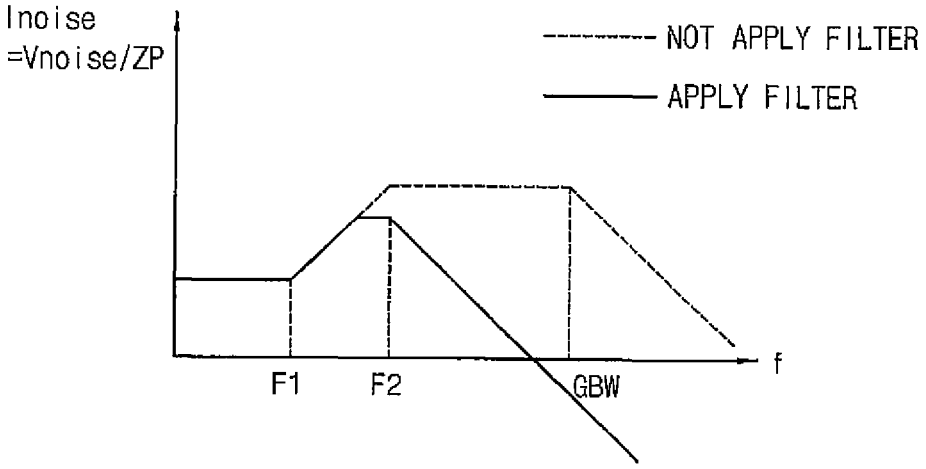

FIG. 10 is a circuit diagram illustrating another example of a noise attenuator, and FIGS. 11A and 11B are graphs for describing an effect of a noise attenuator of FIG. 10.

Referring to FIGS. 10 through 11B, the data driver may include a first filtering capacitor connected to a common source amplifier. Accordingly, the data driver can decrease a current noise occurring when the first current is sensed using the first filtering capacitor, which is implemented in a relatively small space. In addition, the data driver can decrease a current noise occurring when the second current is sensed using the second filtering capacitor, which is implemented in a relatively small space.

The first noise attenuator 340B may include a first filtering capacitor CF1 connected between the first node N1 and a common source amplifier. For example, when the first filtering capacitor CF1 is connected to the common source amplifier including a filtering transistor M4 and a filtering resistance R1, a cutoff frequency of a current low pass filter can decrease despite the first filtering capacitor CF1 of which capacitance is relatively small because of Miller effect. Here, the filtering transistor M4 may include a gate electrode connected to a fourth node N4 between the first cascade transistor MN2 and the second cascode transistor MN3, a first electrode connected to a first power source VDD, and a second electrode connected to the filtering resistance R1. The filtering resistance R1 may be located between a second electrode of the first filtering capacitor CF1 and the ground source.

A current low pass filter may be formed by the first filtering capacitor CF1 and an input impedance of the first cascode transistor MN2. Here, the cutoff frequency FP2 of the current low pass filter may be calculated according to the following Equation 4:

$$FP2 = \frac{g_{MN2}}{2\pi \cdot (1 + g_{M4}R1)CF} \quad \text{Equation 4}$$

where FP2 is the cutoff frequency of the current low pass filter, $g_{MN2}$ is the transconductance of the first cascode transistor MN2, $g_{M4}$ is the transconductance of the filtering transistor M4, R1 is the filtering resistance, and CF is the capacitance on the first filtering capacitor CF1.

Therefore, the filtering capacitor CF1 connected to the common source amplifier may decrease the cutoff frequency FP2 of the current low pass filter similarly to a filtering capacitor that is connected to the ground source.

In addition, the second noise attenuator may include a second filtering capacitor connected between the second node and a common source amplifier. The structure and operation principle of the second noise attenuator is substantially the same as the structure and operation principle of the first noise attenuator. Therefore, duplicated descriptions will be omitted.

Figure 12:
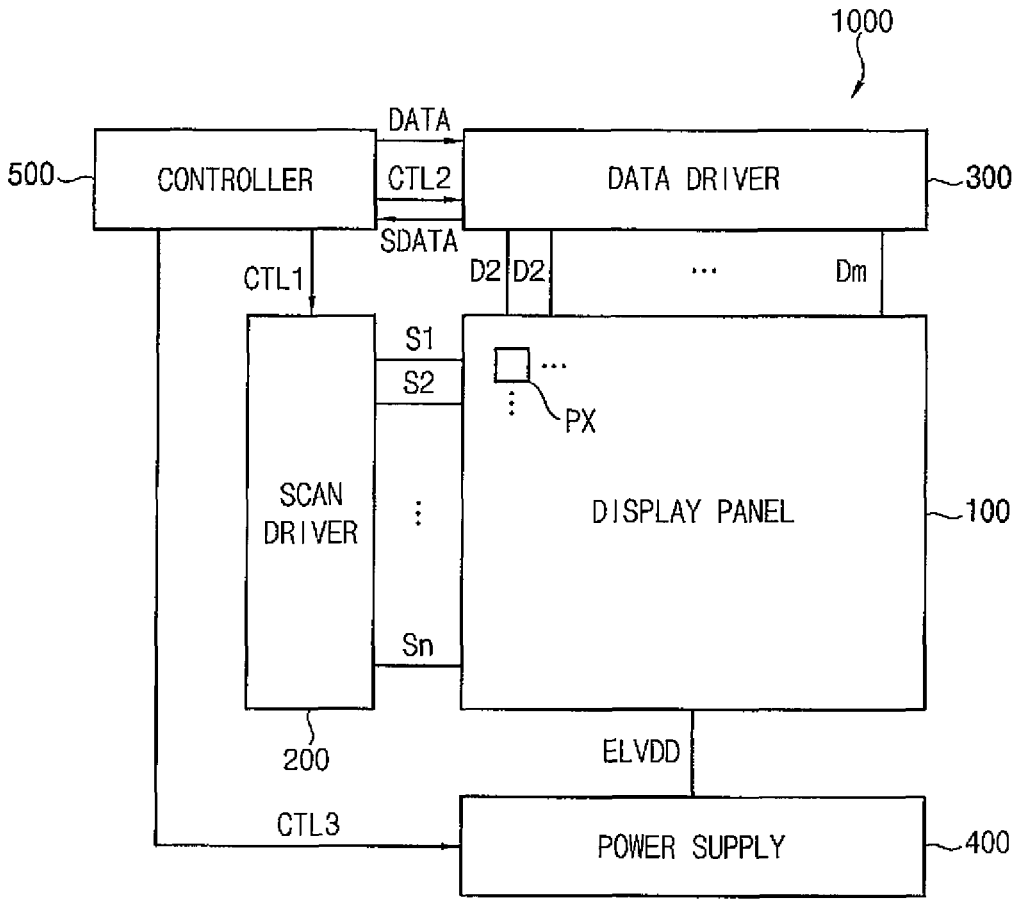
FIG. 12 is a block diagram illustrating an organic light emitting display device according to one example embodiment.

FIG. 12 is a block diagram illustrating an organic light emitting display device according to one example embodiment.

Referring to FIG. 12, the organic light emitting display device 1000 may include a display panel 100, a scan driver 200, a data driver 300, a power supply 400, and a controller 500.

The display panel 100 may include a plurality of pixels PX. For example, the display panel 100 may include n*m pixels PX (n and m are natural numbers), because the pixels PX are arranged at locations corresponding to crossing points of the n number of scan lines SL1 through SLn and the m number of data lines DL1 through DLm.

The scan driver 200 may provide a scan signal to the pixels PX via the scan lines SL1 through SLn based on the first control signal CTL1.

The data driver 300 may provide a data signal to the pixels PX via the data lines DL1 through DLm based on the second control signal CTL2 in a panel-driving mode. The data driver 300 may derive a first deterioration data for organic light emitting diodes included in the pixels PX in a first current-sensing mode, and may derive a second deterioration data for driving transistors included in the pixels PX in a second current-sensing mode. The data driver 300 may provide the derived first and second deterioration data SDATA to the controller 500.

The data driver 300 may include a data signal converter, an output buffer, a first cascode circuit, a first noise attenuator, a second cascode circuit, a second noise attenuator, a current integrator, and an ADC. Since the data driver 300 is substantially the same as the data driver of FIG. 1, duplicated descriptions will be omitted.

In one example embodiment, in the panel-driving mode, the first node may be connected to the first power source, and the second node may be connected to the ground source. Also, the current integrator may be disconnected from the first cascode circuit and the second cascode circuit in the panel-driving mode. The current integrator may form the negative feedback loop to perform a role as the buffer amplifier.

In one example embodiment, in the first current-sensing mode, the current integrator may be connected to the first cascade circuit, and may be disconnected from the second cascode circuit. The current integrator may generate the integrated voltage by integrating the first current flowing through the first cascode circuit to derive the first deterioration data for the OLED in the first current-sensing mode.

In one example embodiment, in the second current-sensing mode, the current integrator may be connected to the second cascode circuit, and may be disconnected from the first cascode circuit. The current integrator may generate the integrated voltage by integrating the second current flowing through the second cascode circuit to derive the second deterioration data for a first transistor (i.e., driving transistor) in the second current-sensing mode.

In one example embodiment, the data signal converter may generate the data signal corresponding to a voltage of an anode electrode of the OLED in the second current-sensing mode. Thus, to decrease a current variation caused by a channel length modulation, the data signal converter may generate the data signal corresponding to a voltage of the anode electrode of the OLED, and the output buffer may output the generated data signal in the second current-sensing mode.

The power supply 400 may provide power sources to the display panel 100. In one example embodiment, the power supply 400 may generate a high power source ELVDD, and may provide the high power source ELVDD to the display panel 100.

The controller 500 may control the scan driver 200, the data driver 300, and the power supply 400 to display an image that is compensated based on the first deterioration data and the second deterioration data. For example, the controller 500 may generate the output image data DATA by compensating the input image data based on the first deterioration data and the second deterioration data. The controller 500 may provide the output image data DATA to the data driver 300.

Therefore, the organic light emitting display device 1000 may effectively sense the deterioration of the pixel using the data driver 300, and may compensate the deterioration of the pixel. Accordingly, the organic light emitting display device 1000 can increase display quality.

Although the example embodiments describe that the cathode electrode of the OLED and the fourth cascode transistor are connected to the ground source, the present invention is not limited thereto. Thus, the ground source can correspond to a second power source.

The present inventive concept may be applied to an electronic device having the organic light emitting display device. For example, the present inventive concept may be applied to a cellular phone, a smart phone, a smart pad, a personal digital assistant (PDA), etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims and their equivalents.

What is claimed is:

1. A data driver comprising:

a data signal converter configured to convert image data to a data signal;

an output buffer configured to output the data signal to a data line;

a first cascode circuit connected to the output buffer and comprising a plurality of transistors connected in series;

a first noise attenuator connected to a first node between the output buffer and the first cascode circuit, and configured to attenuate a first current noise;

a second cascode circuit connected to the output buffer and comprising a plurality of transistors connected in series;

a second noise attenuator connected to a second node between the output buffer and the second cascode circuit, and configured to attenuate a second current noise;

a current integrator configured to generate an integrated voltage by integrating a first current flowing through the first cascode circuit and a second current flowing through the second cascode circuit; and an analog-digital converter (ADC) configured to convert the integrated voltage to a digital signal.

2. The data driver of claim 1, wherein, in a panel-driving mode:

the first node is configured to be connected to a first power source;

the second node is configured to be connected to a ground source; and the current integrator is configured to be disconnected from the first cascode circuit and the second cascode circuit.

3. The data driver of claim 1, wherein, in a first current-sensing mode, the current integrator is configured to be connected to the first cascode circuit, and is configured to be disconnected from the second cascode circuit.

4. The data driver of claim 1, wherein, in a second current-sensing mode, the current integrator is configured to be connected to the second cascode circuit, and is configured to be disconnected from the first cascode circuit.

5. The data driver of claim 1, wherein the output buffer comprises a first amplifier, a first output transistor, and a second output transistor, wherein the first amplifier comprises a first input terminal for receiving the data signal from the data signal converter, a second input terminal connected to a third node, and an output terminal connected to a gate electrode of the first output transistor and to a gate electrode of the second output transistor, wherein the first output transistor comprises the gate electrode connected to the output terminal of the first amplifier, a first electrode connected to the first node, and a second electrode connected to the third node, and wherein the second output transistor comprises the gate electrode connected to the output terminal of the first amplifier, a first electrode connected to the third node, and a second electrode connected to the second node.

6. The data driver of claim 1, wherein the first cascode circuit comprises a first cascade transistor and a second cascode transistor, wherein the first cascode transistor comprises a gate electrode connected to a first bias power source, a first electrode connected to a second electrode of the second cascode transistor, and a second electrode connected to the first node, and wherein the second cascode transistor comprises a gate electrode connected to a first power source, a first electrode connected to the current integrator via a first switch, and the second electrode connected to the first electrode of the first cascode transistor.

7. The data driver of claim 1, wherein the first noise attenuator comprises a first filtering capacitor connected between the first node and a ground source.

8. The data driver of claim 1, wherein the first noise attenuator comprises a first filtering capacitor connected between the first node and a common source amplifier.

9. The data driver of claim 1, wherein the second cascode circuit comprises a third cascode transistor and a fourth cascode transistor, wherein the third cascode transistor comprises a gate electrode connected to a second bias power source, a first electrode connected to the second node, and a second electrode connected to a first electrode of the fourth cascode transistor, and wherein the fourth cascode transistor comprises a gate electrode connected to a ground source, the first electrode connected to the second electrode of the third cascode transistor, and a second electrode connected to the current integrator via a second switch.

10. The data driver of claim 1, wherein the second noise attenuator comprises a second filtering capacitor connected between the second node and a ground source.

11. The data driver of claim 1, wherein the second noise attenuator comprises a second filtering capacitor connected between the second node and a common source amplifier.

12. The data driver of claim 1, wherein the current integrator comprises a first integrating capacitor, a second integrating capacitor, and a second amplifier, wherein the first integrating capacitor is connected between a first input terminal of the second amplifier and a current input node through which the first current and the second current are configured to flow, wherein the second amplifier comprises the first input terminal connected to the first integrating capacitor, a second input terminal connected to a reference source, and an output terminal connected to the ADC, and wherein the second integrating capacitor is connected between the current input node and the output terminal of the second amplifier.

13. The data driver of claim 12, wherein the current input node is configured to be periodically connected to a first power source or to a ground source by a first initialization switch, and wherein the first input terminal of the second amplifier is configured to be periodically connected to the output terminal of the second amplifier by a second initialization switch.

14. The data driver of claim 13, wherein the first initialization switch and the second initialization switch are configured to be turned on at substantially a same time, and wherein the first initialization switch is configured to be turned off earlier than when the second initialization switch is turned off.

15. The data driver of claim 1, wherein the ADC is a second order sigma-delta ADC.

16. An organic light emitting display device comprising:

a display panel comprising a plurality of pixels;

a scan driver configured to provide a scan signal to the pixels via scan lines;

a data driver configured to provide a data signal to the pixels via data lines in a panel-driving mode, configured to derive a first deterioration data for organic light emitting diodes in the pixels in a first current-sensing mode, and configured to derive a second deterioration data for driving transistors in the pixels in a second current-sensing mode; and a controller configured to control the scan driver and the data driver to display an image based on the first deterioration data and the second deterioration data, wherein the data driver comprises:

a data signal converter configured to convert image data to the data signal;

an output buffer configured to output the data signal to the data line;

a first cascode circuit connected to the output buffer, and comprising a plurality of transistors connected in series;

a first noise attenuator connected to a first node between the output buffer and the first cascode circuit, and configured to attenuate a first current noise;

a second cascode circuit connected to the output buffer, and comprising a plurality of transistors connected in series;

a second noise attenuator connected to a second node between the output buffer and the second cascode circuit, and configured to attenuate a second current noise;

a current integrator configured to generate an integrated voltage by integrating a first current flowing through the first cascode circuit and a second current flowing through the second cascode circuit; and an analog-digital converter (ADC) configured to convert the integrated voltage to a digital signal.

17. The organic light emitting display device of claim 16, wherein, in the panel-driving mode, the first node is configured to be connected to a first power source, the second node is configured to be connected to a ground source, and the current integrator is configured to be disconnected from the first cascode circuit and the second cascode circuit.

18. The organic light emitting display device of claim 16, wherein, in the first current-sensing mode, the current integrator is configured to be connected to the first cascode circuit and is configured to be disconnected from the second cascade circuit.

19. The organic light emitting display device of claim 16, wherein, in the second current-sensing mode, the current integrator is configured to be connected to the second cascode circuit and is configured to be disconnected from the first cascode circuit.

20. The organic light emitting display device of claim 19, wherein, in the second current-sensing mode, the data signal converter is configured to generate the data signal corresponding to a voltage of an anode electrode of the organic light emitting diodes.

* * * * *